US007924258B2

(12) United States Patent
O et al.

(10) Patent No.: US 7,924,258 B2
(45) Date of Patent: Apr. 12, 2011

(54) GATE DRIVING APPARATUS FOR PREVENTING DISTORTION OF GATE START PULSE AND IMAGE DISPLAY DEVICE USING THE SAME AND DRIVING METHOD THEREOF

(75) Inventors: Seung Cheol O, Seoul (KR); Soon Dong Cho, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 780 days.

(21) Appl. No.: 11/527,723

(22) Filed: Sep. 27, 2006

(65) Prior Publication Data

US 2007/0085812 A1 Apr. 19, 2007

(30) Foreign Application Priority Data

Sep. 27, 2005 (KR) ..... 10-2005-0089984

(51) Int. Cl.
*G09G 3/36* (2006.01)

(52) U.S. Cl. ..... 345/100

(58) Field of Classification Search ..... 345/204, 345/87–111, 210–211, 690
See application file for complete search history.

(56) References Cited

U.S. PATENT DOCUMENTS

| | | | | |
|---|---|---|---|---|
| 2003/0122765 | A1* | 7/2003 | Yoon | 345/94 |
| 2004/0174330 | A1* | 9/2004 | Huang et al. | 345/100 |
| 2004/0189583 | A1* | 9/2004 | Park et al. | 345/100 |
| 2005/0035958 | A1* | 2/2005 | Moon | 345/204 |
| 2005/0156861 | A1* | 7/2005 | Song | 345/100 |
| 2007/0057898 | A1* | 3/2007 | Nakajima et al. | 345/100 |

FOREIGN PATENT DOCUMENTS

WO WO 2004105221 * 12/2004

OTHER PUBLICATIONS

Data Sheet—74HC/HCT157 Quad 2-input Multiplexer, Dec. 1990, Phillips, Page : p. 4, Fig. 5.*

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

A gate driving apparatus and image display device using the same and driving method thereof comprises a start pulse generator which generates a second gate start pulse by a logic operation of a first gate start pulse and a gate output enable signal, a shift register which generates a shift signal by sequentially shifting the second gate start pulse in accordance with a gate shift clock, and an output unit which outputs the shift signal in accordance with the gate output enable signal.

16 Claims, 6 Drawing Sheets

GATE DRIVING APPARATUS FOR PREVENTING DISTORTION OF GATE START PULSE AND IMAGE DISPLAY DEVICE USING THE SAME AND DRIVING METHOD THEREOF

This application claims the benefit of the Korean Patent Application No. P2005-89984, filed on Sep. 27, 2005, which is hereby incorporated by reference.

BACKGROUND OF THE INVENTION

1. Field of the Invention

The present invention relates to an image display device, and more particularly to a gate driving apparatus to prevent a deterioration of picture quality caused by a gate flickering phenomenon, and an image display device using the gate driving apparatus and a driving method thereof.

2. Discussion of the Related Art

With development in the information society, demands for various display devices have increased. Accordingly, significant efforts have been made to research and develop various flat display devices such as liquid crystal display (LCD), plasma display panel (PDP), electroluminescent display (ELD), and vacuum fluorescent display (VFD). Some species of the flat display devices are already applied to displays of various equipments.

FIG. 1 is a block diagram of schematically illustrating a related art LCD device. As shown in FIG. 1, the related art LCD device is provided with an LCD panel 10 which includes a plurality of gate lines (GL1 to GLn) and data lines (DL1 to DLm) formed perpendicularly. The data driver 20 supplies video signals to the data lines (DL1 to DLm), the gate driver 30 supplies scan pulses to the gate lines (GL1 to GLn), and the timing controller 40 controls the driving timing of the data and gate drivers 20 and 30.

The LCD panel 10 includes a plurality of thin film transistors (TFTs) formed in portions defined by n gate lines (GL1 to GLn) and m data lines (DL1 to DLm). A plurality of liquid crystal cells are connected with the thin film transistors (TFTs). Each thin film transistor (TFT) supplies the video signal provided from the data lines (DL1 to DLm) to the liquid crystal cell in response to the scan pulse provided from the gate lines (GL1 to GLn). The liquid crystal cell is provided with a common electrode and a pixel electrode being connected with the thin film transistor (TFT). The liquid crystal layer is disposed between the common electrode and the pixel electrode. Thus, the liquid crystal cell may be equivalently represented as a liquid crystal capacitor (Clc). In addition, the liquid crystal cell includes a storage capacitor (Cst) that maintains the data voltage charged in the liquid crystal capacitor (Clc) until the next data signal is charged.

The timing controller 40 arranges the source data (RGB) that is provided from the external source to be appropriate for the driving of the LCD panel 10. Thereafter, the timing controller 40 supplies the arranged source data to the data driver 20. In addition, the timing controller 40 generates control signals (DCS, GCS) to control the data driver 20 and the gate driver 30 by using synchronization signals (DE, DCLK, Hsync, Vsync) provided from the external source.

The data driver 20 converts the data (Data) provided from the timing controller 40 to an analog video signal in accordance with the data control signal (DCS) provided from the timing controller 40. Thereafter, the data driver 20 supplies the analog video signal to the data lines (DL1 to DLm) for one horizontal line by one horizontal period to supply the scan pulse to each gate line (GL1 to GLn). In particular, the data driver 20 selects one gamma voltage corresponding to the data (Data) from a plurality of gamma voltages, takes the selected gamma voltage as the analog video signal, and supplies the selected gamma voltage to the data lines (DL1 to DLm).

The gate driver 30 generates the scan pulse, that is, high gate pulse in accordance with the gate control signal (GCS) provided from the timing controller 40, and sequentially supplies the generated scan pulse to the gate lines (GL1 to GLn). In response to the scan pulses, the thin film transistor (TFT) is turned-on, whereby the video signal of the data line (DL1 to DLm) is supplied to the capacitors (Clc) of the corresponding liquid crystal cells.

FIG. 2 is a circuit diagram illustrating the gate driver shown in FIG. 1 according to the related art. As shown in FIG. 2, the related art gate driver 30 is provided with a shift register 32, a logic-operation unit 36, a level-shift unit 38, and a buffering unit 39.

The shift register 32 sequentially generates a shift signal by using a gate start pulse (GSP) and a gate shift clock (GSC). In particular, the shift register 32 includes n-th flip-flops which sequentially shift the gate start pulse (GSP) in accordance with the gate shift clock (GSC).

The logic-operation unit 36 performs a logic operation for the shift signal provided from the shift register 32 and a gate output enable signal (GOE), and supplies the result to the level-shift unit 38. In particular, the logic operation unit 36 includes an inverter 34 which inverts and outputs the gate output enable signal (GOE), and the AND-gates which are connected with respective output terminals of the flip-flops of the shift register 32 and an output terminal of the inverter 34. The AND-gates supply an output signal of a high state to the level-shift unit 38 when the inverted gate output enable signal (GOE) and the shift signal provided from the flip-flop are both in the high state. If either signal is in the low state, the AND-gates supply an output signal of a low state to the level-shift unit 38.

The level-shift unit 38 includes n level shifters, each connected with each output terminal of the AND-gates. The level shifters shift the output signal provided from each AND-gate to the level suitable for the driving of liquid crystal cell, and supplies the shifted signal to the buffering unit 39.

The buffering unit 39 includes n buffers, each connected with each output terminal of the level shifters. The buffers buffer the output signal provided from each level shifter corresponding to the load of gate lines (GL1 to GLn), and supply the buffered signal to the gate lines (GL1 to GLn).

As shown in FIG. 3, the gate driver 30 according to the related art sequentially shifts the gate start pulse (GSP) in accordance with the gate shift clock (GSC). Furthermore, the gate driver 30 generates a level shift signal in accordance with the gate output enable signal (GOE), and sequentially supplies the level shifted signal to the gate lines (GL1 to GLn). The related art LCD device sequentially supplies the scan pulse to the gate lines (GL1 to GLn) of the LCD panel 10 by using the gate driver 30. At the same time, the LCD device supplies the video signal to the data lines (DL1 to DLm) in synchronization with the scan pulse, to thereby display the desired image.

However, as shown in FIG. 4, if the gate start pulse (GSP) is distorted due to the electric shock or noise, the scan pulse supplied to the LCD panel 10 can be provided non-sequentially, or even partially-overlapped, thereby generating a gate flickering phenomenon wherein images are shifted or overlapped. Accordingly, the picture quality is deteriorated due to a gate flickering phenomenon generated by the electric shock or noise.

SUMMARY OF THE INVENTION

Accordingly, the present invention is directed to a gate driving apparatus and an image display device using the same and a driving method thereof, that substantially obviates one or more problems due to limitations and disadvantages of the related art.

An object of the present invention is to provide a gate driving apparatus to prevent a deterioration of picture quality caused by a gate flickering phenomenon, and an image display device using the same and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the gate driving apparatus includes a start pulse generator which generates a second gate start pulse by a logic operation of a first gate start pulse and a gate output enable signal, a shift register which generates a shift signal by sequentially shifting the second gate start pulse in accordance with a gate shift clock, and an output unit which outputs the shift signal in accordance with the gate output enable signal.

In another aspect, the image display unit includes a display panel having a plurality of pixel cells formed in portions defined by a plurality of gate and data lines formed perpendicularly, a gate driver which supplies a scan pulse to the gate line, a data driver which supplies a video signal to the data line, and a timing controller which controls the gate and data drivers, wherein the gate driver comprises a start pulse generator which generates a second gate start pulse by a logic operation of a first gate start pulse and a gate output enable signal provided from the timing controller, a shift register which generates a shift signal by sequentially shifting the second gate start pulse in accordance with a gate shift clock provided from the timing controller, and an output unit which outputs the shift signal to the gate line in accordance with the gate output enable signal.

In another aspect, the driving method of a gate driving apparatus includes a step 1 which generates a second gate start pulse by performing a logic operation to a first gate start pulse and a gate output enable signal, a step 2 which generates a shift signal by sequentially shifting the second gate start pulse in accordance with a gate shift clock, and a step 3 which outputs the shift signal in accordance with the gate output enable signal.

In another aspect, the driving method of an image display device including a display panel provided with a plurality of pixel cells formed in portions defined by a plurality of gate and data lines formed perpendicularly includes supplying a scan pulse to the gate line, and supplying a video signal to the data line in synchronization with the scan pulse, wherein the step of supplying the scan pulse to the gate line comprises a step 1 which generates a second gate start pulse by performing a logic operation to a first gate start pulse and a gate output enable signal, a step 2 which generates a shift signal by sequentially shifting the second gate start pulse in accordance with a gate shift clock, and a step 3 which outputs the shift signal to the gate line in accordance with the gate output enable signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
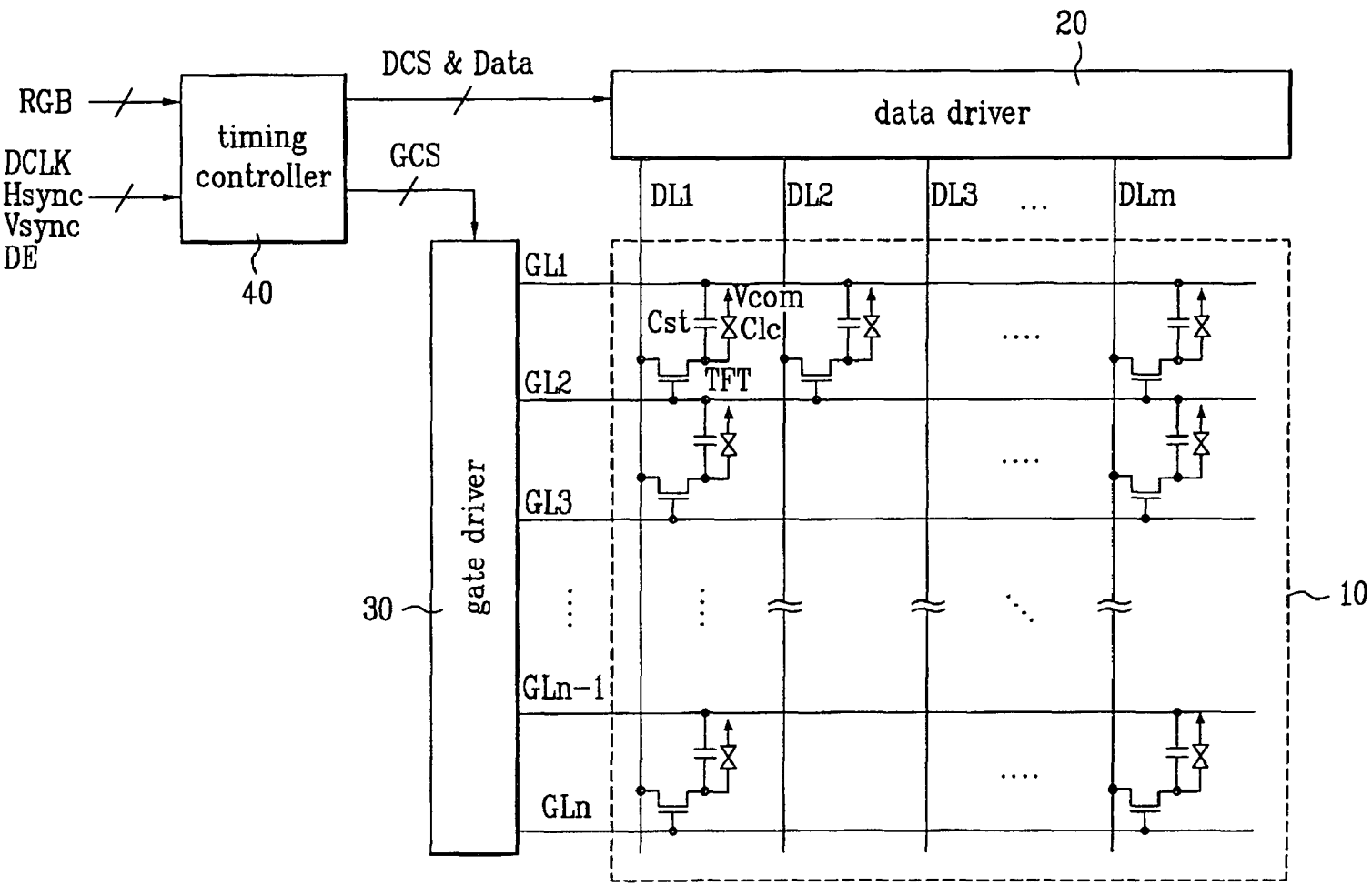
FIG. 1 is a block diagram illustrating a related art LCD device.
Figure 2:
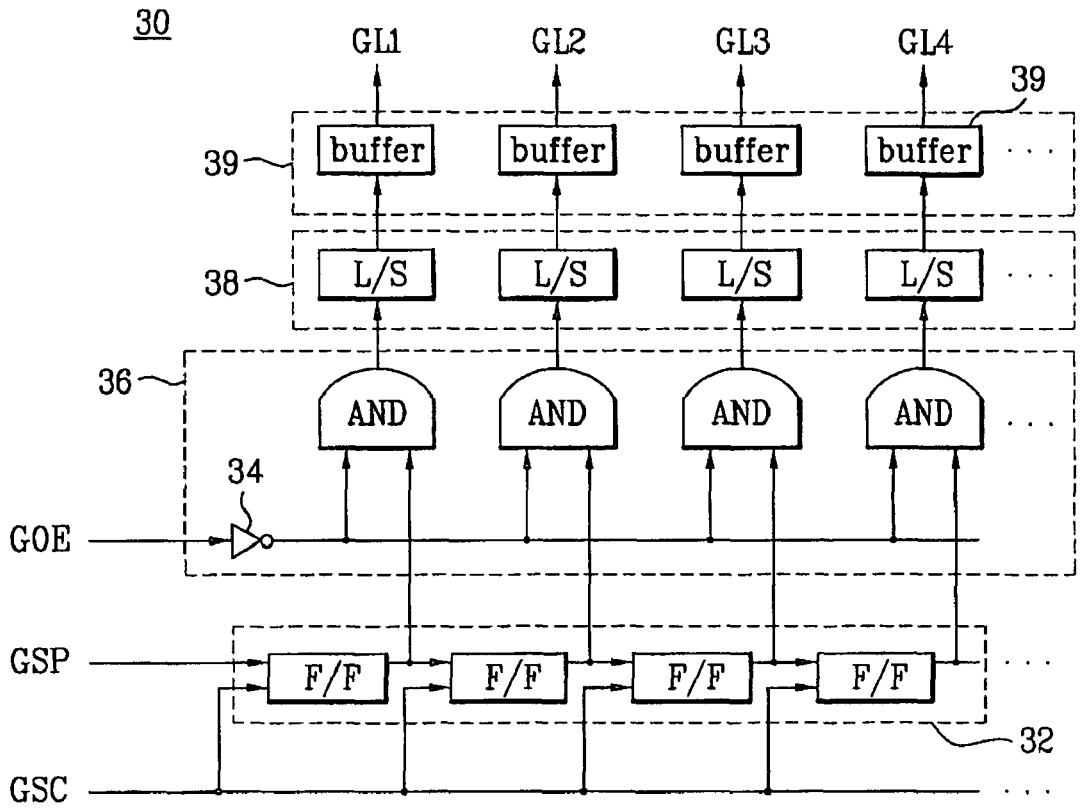
FIG. 2 is a circuit diagram illustrating a gate driver according to the related art shown in FIG. 1.
Figure 3:
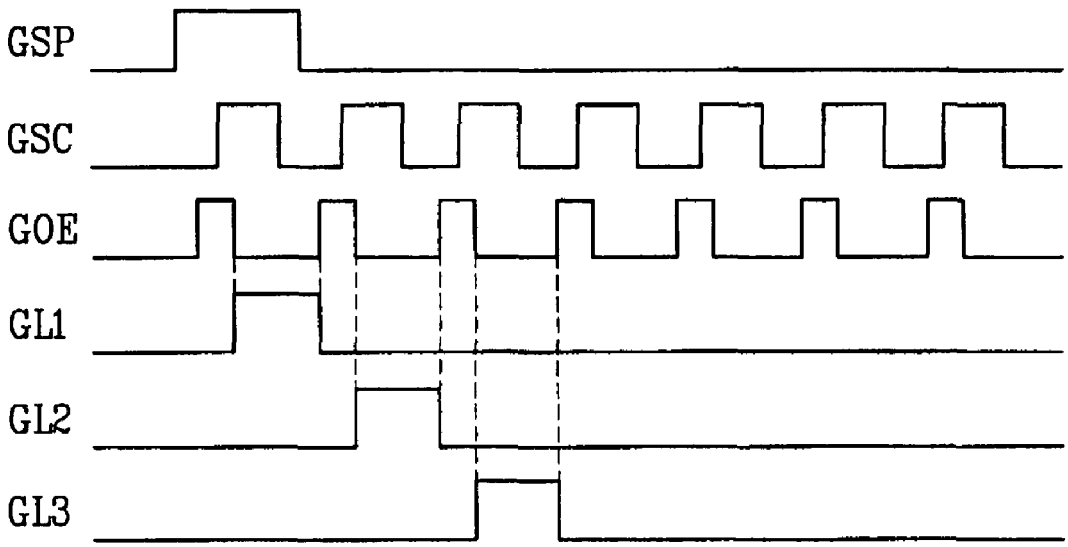
FIG. 3 is a waveform diagram illustrating input and output of a gate driver according to the related art shown in FIG. 2.
Figure 4:
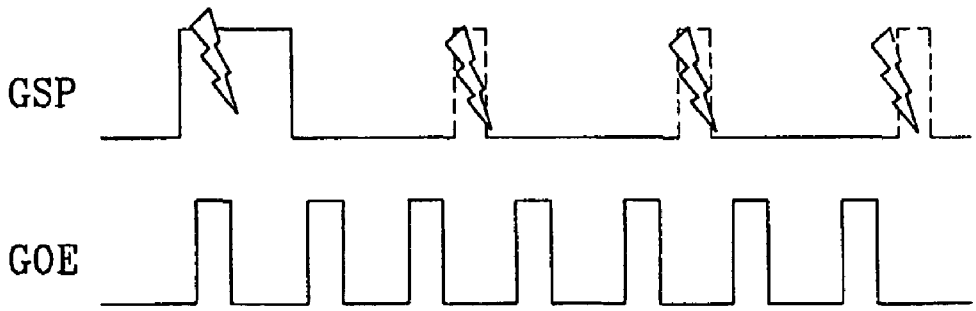
FIG. 4 is a waveform diagram illustrating a distortion of a gate start pulse caused by noise in a gate driver according to the related art.
Figure 5:
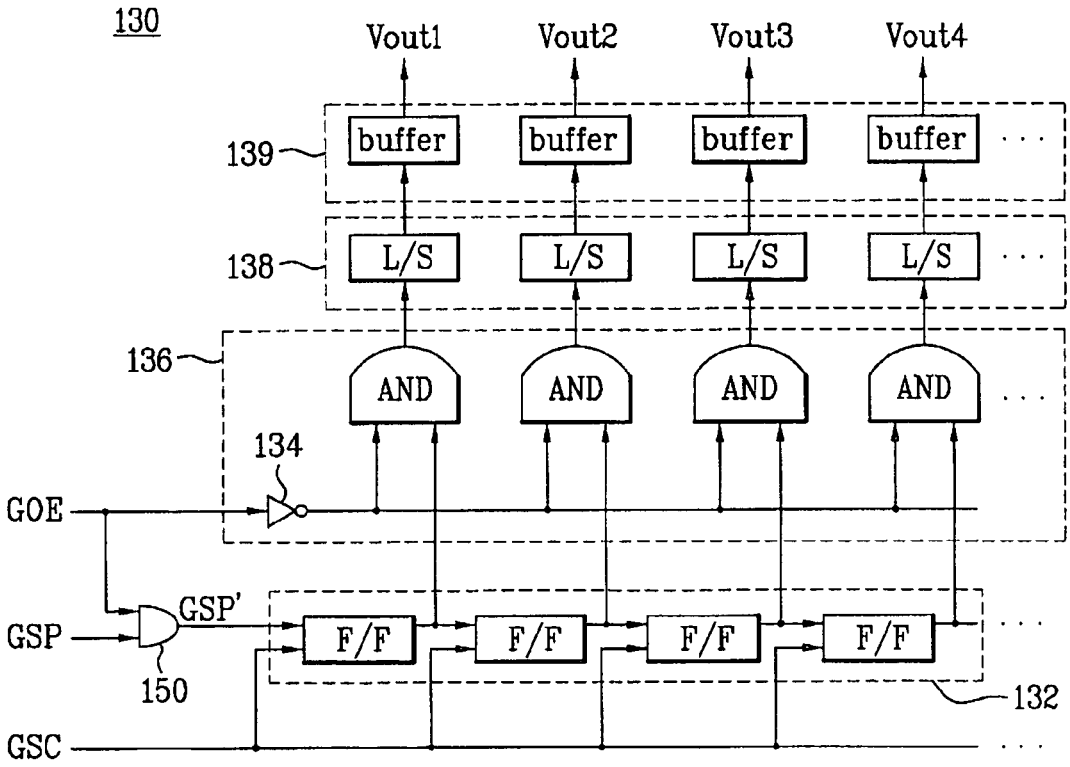
FIG. 5 is an exemplary circuit diagram illustrating a gate driving apparatus according to the present invention.

FIG. 5 is an exemplary circuit diagram illustrating a gate driving apparatus according to the present invention. As shown in FIG. 5, the gate driving apparatus 130 according to the present invention includes a start pulse generator 150, a shift register 132, a logic-operation unit 136, a level-shift unit 138, and a buffering unit 139.

The start pulse generator 150 includes an AND-gate. The input ports of the AND-gate are connected to a first gate start pulse (GSP) input line and a gate output enable signal (GOE) input line. If both the first gate start pulse (GSP) and the gate output enable signal (GOE) are in a high state, the start pulse generator 150 supplies a second gate start pulse (GSP') of a high state to the shift register 132. If either the first gate start pulse (GSP) or the gate output enable signal (GOE) is not in the high state, the start pulse generator 150 supplies a second gate start pulse (GSP') of a low state to the shift register 132.

The shift register 132 sequentially generates shift signals by using a gate shift clock (GSC) and the second gate start pulse (GSP') provided from the start pulse generator 150. In particular, the shift register 132 includes n flip-flops which sequentially shift the second gate start pulse (GSP') in accordance with the gate shift clock (GSC).

The logic-operation unit 136 performs a logic AND operation to the gate output enable signal (GOE) and the shift signal provided from the shift register 132, and supplies the resulting signal to the level-shift unit 138. In particular, the logic operation unit 136 includes an inverter 134 which inverts the gate output enable signal (GOE), and n AND-gates each input ports of which are connected to each output terminal of the flip-flops and the output terminal of the inverter 134.

The n AND-gates supply output signals of a high state to the level-shift unit 138 when both the inverted gate output enable signal (GOE) and the shift signal provided from the flip-flop are in a high state. Otherwise, the AND-gates supply output signals of a low state to the level-shift unit 138. The level-shift unit 138 includes n level shifters, each connected with the output terminal of each AND-gate of the logic-operation unit 136. The n level shifters shift the output signal provided from each AND-gate to the level suitable for driving the load connected to the last output terminal (Vout1, Vout2, . . . ), and supplies the shifted signal to the buffering unit 139.

The buffering unit 139 includes n buffers connected with the respective output terminals of the level shifters. The buffers buffer the output signal provided from the level shifters, and outputs the buffered signal to the load through the last output terminal (Vout1, Vout2, . . . ).

Figure 6:
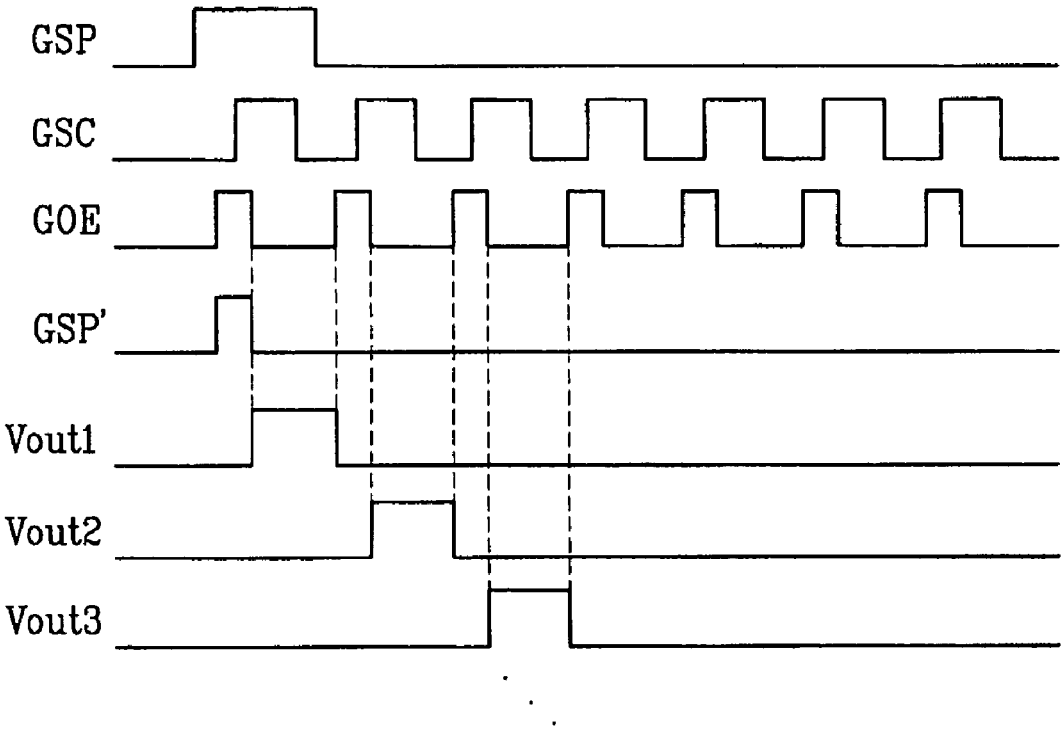
FIG. 6 is an exemplary waveform diagram illustrating input and output of a gate driving apparatus shown in FIG. 5.

As shown in FIG. 6, the exemplary gate driving apparatus according to the present invention generates the second gate start pulse (GSP') by the logic operation of the first gate start pulse (GSP) and the gate output enable signal (GOE). The gate driving apparatus generates the shift signal by sequentially shifting the second gate start pulse (GSP') in accordance with the gate shift clock (GSC), and further level-shifts the shift signal in accordance with the gate output enable signal (GOE). Accordingly, the gate driving apparatus outputs the shift signal level-shifted to the load through the last output terminal (Vout1, Vout2, . . . .

Figure 7:
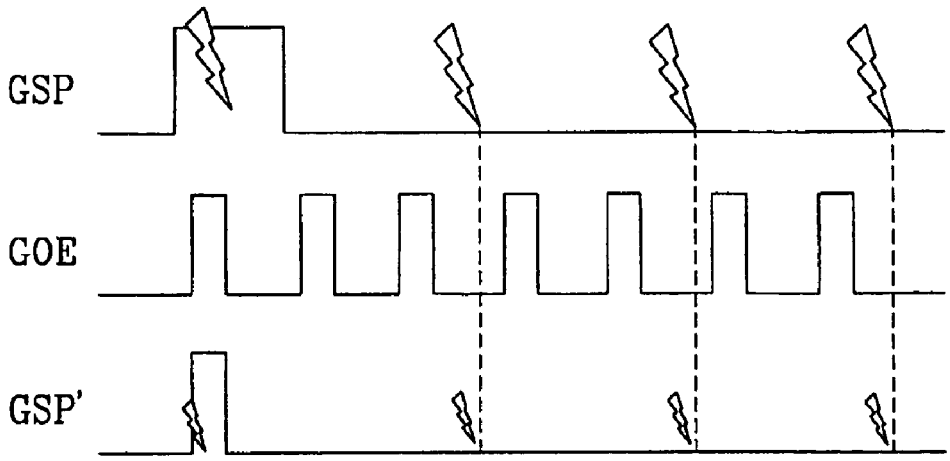
FIG. 7 is an exemplary waveform diagram illustrating a start pulse generator shown in FIG. 6.

As shown in FIG. 7, even though the first gate start pulse (GSP) is distorted due to electric shock or noise, the gate driving apparatus generates the second gate start pulse (GSP') of high state only when both the first gate start pulse (GSP) and the gate output enable signal (GOE) are in the high state. Therefore, it is possible to prevent the deterioration of picture quality caused by the gate flickering phenomenon.

Figure 8:
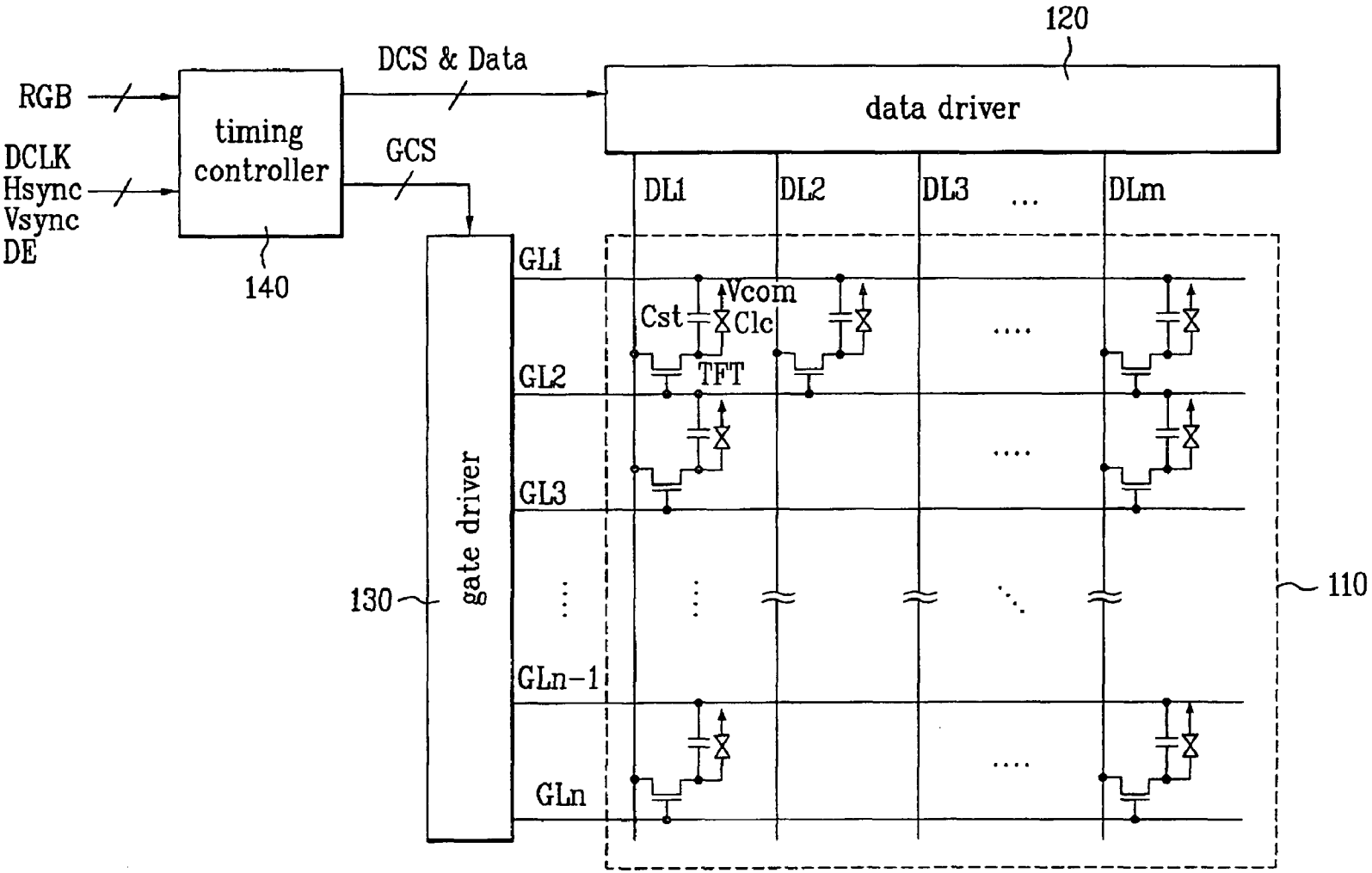
FIG. 8 is an exemplary block diagram illustrating an image display device according to the present invention.

FIG. 8 is an exemplary block diagram of illustrating an image display device according to the present invention. As shown in FIG. 8, the image display device according to the present invention is provided with a display panel 110 which includes a plurality of gate lines (GL1 to GLn) and data lines (DL1 to DLm) formed perpendicularly. The data driver 120 supplies video signals to the data lines (DL1 to DLm), and the gate driver 130 supplies scan pulses to the gate lines (GL1 to GLn). The timing controller 140 controls the driving timing of the data and gate drivers 120 and 130.

The Display panel 110 includes a plurality of thin film transistors (TFTs) formed in portions defined by n gate lines (GL1 to GLn) and m data lines (DL1 to DLm). A plurality of pixel cells are connected with the thin film transistors (TFTs). Each thin film transistor (TFT) supplies the video signal provided from the data line (DL1 to DLm) to the pixel cell in response to the scan pulse provided from the gate line (GL1 to GLn). The pixel cell is provided with a common electrode and a pixel electrode being connected with the thin film transistor (TFT). The liquid crystal layer is disposed between the common electrode and the pixel electrode. Thus, the pixel cell may be equivalently represented as a liquid crystal capacitor (Clc). The pixel cell further includes a storage capacitor (Cst) that maintains the data voltage charged in the liquid crystal capacitor (Clc) until the next data signal is charged.

The timing controller 140 arranges source data (RGB) provided from the external to be appropriate for the driving of the Display panel 1 10, and supplies the arranged data (Data) to the data driver 120. Also, the timing controller 140 generates a data control signal (DCS) for controlling the data driver 120, and a gate control signal (GCS) for controlling the gate driver 130, by using a data enable signal (DE), a dot clock signal (DCLK), a horizontally synchronized signal (Hsync) and a vertically synchronized signal (Vsync) which are provided from the external source.

The data driver 120 converts data (Data) provided from the timing controller 140 to an analog video signal in accordance with the data control signal (DCS) provided from the timing controller 140. Thereafter, the data driver 120 supplies the analog video signal to the data lines (DL1 to DLm) for one horizontal line by one horizontal period to supply the scan pulse to each gate line (GL1 to GLn). In particular, the data driver 120 selects one gamma voltage corresponding to the data (Data) from a plurality of gamma voltages, takes the selected gamma voltage as the analog video signal, and supplies the selected gamma voltage to the data lines (DL1 to DLm).

The gate driver 130 generates the scan pulse, that is, high gate pulse in accordance with the gate control signal (GCS) provided from the timing controller 140, and sequentially supplies the generated scan pulse to the gate lines (GL1 to GLn). In response to the scan pulses, the thin film transistor (TFT) is turned-on, whereby the video signal of the data line (DL1 to DLm) is supplied to the capacitors (Clc) of the corresponding liquid crystal cells.

The detailed explanation for the gate driver 130 is provided with reference to FIGS. 5 to 7. As shown in FIGS. 5 and 6, the image display device according to the present invention generates the second gate start pulse (GSP') by the logic operation of the first gate start pulse (GSP) and the gate output enable signal (GOE). The device further generates a shift signal by sequentially shifting the second gate start pulse (GSP') in accordance with the gate shift clock (GSC). Thereafter, the device level-shifts the shift signal to the voltage-level of the scan pulse in accordance with the gate output enable signal (GOE), and sequentially supplies the level-shifted signal to the gate lines (GL1 to GLn). The image display device according to the present invention supplies the video signal to the data lines (DL1 to DLm) in synchronization with the scan pulse provided to the gate lines (GL1 to GLn), to thereby display the desired images.

Meanwhile, the gate driving apparatus according to the present invention may be applied to a flat display device including an LCD device, and a scan driving apparatus to generate a scan pulse by using a gate start pulse and a gate output enable signal. As mentioned above, the gate driving apparatus and the image display device using the same according to the present invention have advantages including preventing distortion of the gate start pulse caused by the electric shock and noise, thereby minimizing the defective images generated by the gate flickering phenomenon.

It will be apparent to those skilled in the art that various modifications and variations can be made in the gate driving apparatus and image display device using the same and driving method thereof of the present invention without departing form the spirit or scope of the invention. Thus, it is intended that the present invention cover the modifications and variations of this invention provided they come within the scope of the appended claims and their equivalents.

What is claimed is:

1. A gate driving apparatus, comprising:

a start pulse generator which generates a second gate start pulse by a logic operation of a first gate start pulse and a gate output enable signal, wherein the second gate start pulse synchronizes with a first pulse of the gate output enable signal, the first pulse overlapping the first gate start pulse;

a shift register including a plurality of flip-flops which generates a shift signal by sequentially shifting the second gate start pulse in accordance with a gate shift clock, wherein the second gate start pulse output from the start pulse generator is supplied to a first flip-flop among the plurality of flip-flops; and an output unit which outputs the shift signal in accordance with the gate output enable signal, wherein the second gate start pulse is high state only when both the first gate start pulse and the gate output enable signal are in the high state, a pulse width of the gate output enable signal is the same as a pulse width of the second gate start pulse, and each pulse width of the gate output enable signal and the second gate start pulse is smaller than a pulse width of the first gate start pulse.

2. The gate driving apparatus of claim 1, wherein the start pulse generator is formed of an AND-gate which performs an AND operation to the first gate start pulse and the gate output enable signal.

3. The gate driving apparatus of claim 1, wherein the output unit includes:

an inverter in a logic-operation unit which inverts the gate output enable signal, the logic-operation unit generating an output signal by performing a logic operation to the shift signal and the inverted gate output enable signal; and a level-shift unit which level-shifts the output signal from the logic-operation unit.

4. The gate driving apparatus of claim 3, wherein the logic-operation unit includes a plurality of AND-gates which perform the AND operation to the shift signal and the inverted gate output enable signal.

5. An image display unit, comprising:

a display panel having a plurality of pixel cells formed in portions defined by a plurality of gate and data lines formed perpendicularly;

a gate driver which supplies a scan pulse to the gate line;

a data driver which supplies a video signal to the data line; and a timing controller which controls the gate and data drivers, wherein the gate driver comprises:

a start pulse generator which generates a second gate start pulse by a logic operation of a first gate start pulse and a gate output enable signal provided from the timing controller, wherein the second gate start pulse synchronizes with a first pulse of the gate output enable signal, the first pulse overlapping the first gate start pulse;

a shift register including a plurality of flip-flops which generates a shift signal by sequentially shifting the second gate start pulse in accordance with a gate shift clock provided from the timing controller, wherein the second gate start pulse output from the start pulse generator is supplied to a first flip-flop among the plurality of flip-flops; and an output unit which outputs the shift signal to the gate line in accordance with the gate output enable signal, wherein the second gate start pulse is high state only when both the first gate start pulse and the gate output enable signal are in the high state, a pulse width of the gate output enable signal is the same as a pulse width of the second gate start pulse, and each pulse width of the gate output enable signal and the second gate start pulse is smaller than a pulse width of the first gate start pulse.

6. The image display device of claim 5, wherein the start pulse generator is formed of an AND-gate which performs an AND operation of the first gate start pulse and the gate output enable signal.

7. The image display device of claim 5, wherein the output unit includes:

an inverter in a logic-operation unit which inverts the gate output enable signal, the logic-operation unit generating an output signal by performing a logic operation to the shift signal and the inverted gate output enable signal; and a level-shift unit which level-shifts the output signal from the logic-operation unit, and outputs the level-shifted signal to the gate line.

8. The image display device of claim 7, wherein the logic-operation unit includes a plurality of AND-gates which perform the AND operation of the shift signal and the inverted gate output enable signal.

9. A driving method of a gate driving apparatus, comprising:

a step 1: generating a second gate start pulse by performing a logic operation to a first gate start pulse and a gate output enable signal, wherein the second gate start pulse synchronizes with a first pulse of the gate output enable signal, the first pulse overlapping the first gate start pulse;

a step 2: generating a shift signal by sequentially shifting the second gate start pulse in accordance with a gate shift clock by a shift register including a plurality of flip-flops, wherein the second gate start pulse output from a start pulse generator is supplied to a first flip-flop among the plurality of flip-flops; and a step 3: outputting the shift signal in accordance with the gate output enable signal, wherein the second gate start pulse is high state only when both the first gate start pulse and the gate output enable signal are in the high state, a pulse width of the gate output enable signal is the same as a pulse width of the second gate start pulse, and each pulse width of the gate output enable signal and the second gate start pulse is smaller than a pulse width of the first gate start pulse.

10. The driving method of claim 9, wherein the logic operation of the step 1 corresponds to an AND operation.

11. The driving method of claim 9, wherein the step 3 comprises:

a step 3-1: performing the logic operation to the shift signal and an inverted gate output enable signal; and a step 3-2: level-shifting the output signal from the step 3-1.

12. The driving method of claim 11, wherein the logic operation of the step 3-1 corresponds to an AND operation.

13. A driving method of an image display device including a display panel provided with a plurality of pixel cells formed in portions defined by a plurality of gate and data lines formed perpendicularly comprising:

supplying a scan pulse to the gate line; and supplying a video signal to the data line in synchronization with the scan pulse, wherein the step of supplying the scan pulse to the gate line comprises:

a step 1: generating a second gate start pulse by performing a logic operation to a first gate start pulse and a gate output enable signal, wherein the second gate start pulse synchronizes with a first pulse of the gate output enable signal, the first pulse overlapping the first gate start pulse;

a step 2: generating a shift signal by sequentially shifting the second gate start pulse in accordance with a gate shift clock by a shift register including a plurality of flip-flops, wherein the second gate start pulse output from a start pulse generator is supplied to a first flip-flop among the plurality of flip-flops; and a step 3: outputting the shift signal to the gate line in accordance with the gate output enable signal, wherein the second gate start pulse is high state only when both the first gate start pulse and the gate output enable signal are in the high state, a pulse width of the gate output enable signal is the same as a pulse width of the second gate start pulse, and each pulse width of the gate output enable signal and the second gate start pulse is smaller than a pulse width of the first gate start pulse.

14. The driving method of claim 13, wherein the logic operation of the step 1 corresponds to an AND operation.

15. The driving method of claim 13, wherein the step 3 comprises:

a step 3-1: performing the logic operation of the shift signal and an inverted gate output enable signal; and a step 3-2: level-shifting the output signal from the step 3-1, and outputs the level-shifted signal to the gate line.

16. The driving method of claim 15, wherein the logic operation of the step 3-1 corresponds to an AND operation.

* * * * *